US011773522B2

(12) United States Patent
Yoon et al.

(10) Patent No.: US 11,773,522 B2
(45) Date of Patent: Oct. 3, 2023

(54) HOUSEHOLD APPLIANCE GUIDED PROVISIONING

(71) Applicant: Haier US Appliance Solutions, Inc., Wilmington, DE (US)

(72) Inventors: Je Kwon Yoon, Seongnam (KR); Janghwan Hahn, Louisville, KY (US); Hansung Park, Bucheon-si (KR); Junho Kang, Gyeonggi (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 5 days.

(21) Appl. No.: 17/575,912

(22) Filed: Jan. 14, 2022

(65) Prior Publication Data

US 2023/0228024 A1 Jul. 20, 2023

(51) Int. Cl.

| | |
|---|---|
| ***D06F 34/05*** | (2020.01) |
| ***D06F 34/28*** | (2020.01) |
| *D06F 105/60* | (2020.01) |

(52) U.S. Cl.
CPC ..... *D06F 34/05* (2020.02); *D06F 34/28* (2020.02); *D06F 2105/60* (2020.02)

(58) Field of Classification Search
CPC ..... D06F 34/05
See application file for complete search history.

(56) References Cited

U.S. PATENT DOCUMENTS 10,959,146 B2 3/2021 Fujita

FOREIGN PATENT DOCUMENTS

| | | |
|---|---|---|
| CN | 106647665 A | 5/2017 |
| WO | WO2020253563 A1 | 12/2020 |

*Primary Examiner* — Jason Y Ko
(74) *Attorney, Agent, or Firm* — Dority & Manning, P.A.

(57) ABSTRACT

A method of provisioning a household appliance includes transmitting a signal from the household appliance to a remote user interface device and receiving, by the household appliance, an acknowledgement from the remote user interface device in response to the signal. The method also includes providing an indication on a user interface physically connected to the household appliance. The indication indicates an element of the user interface physically connected to the household appliance to select in order to cause the household appliance to enter commissioning mode.

20 Claims, 7 Drawing Sheets

HOUSEHOLD APPLIANCE GUIDED PROVISIONING

FIELD OF THE INVENTION

The present subject matter relates generally to household appliances which can connect to a home network and/or a remote network such as the internet. In particular, the present subject matter relates to a household appliance configured for improved provisioning of the household appliance to a user account and related methods.

BACKGROUND OF THE INVENTION

Household appliances are utilized generally for a variety of tasks by a variety of users. For example, a household may include such appliances as laundry appliances, e.g., a washer and/or dryer, kitchen appliances, e.g., a refrigerator, a microwave, a dishwasher, and/or a coffee maker, along with room air conditioners and other various appliances.

Some household appliances can also include features for connecting to and communicating over a secure wireless network. Such communication may provide connected features on the household appliances, e.g., where the household appliance communicates with a personal device, smart home systems, and/or a remote database such as a cloud server.

Typically, such household appliances require a user to physically touch a portion of a user interface physically connected to the household appliances, such as a button or key on the household appliance, in order to establish a connection or association, in particular an initial connection or association, between the household appliance and a user account or network. The portion of the user interface, e.g., button or key, that must be touched, e.g., pressed, may be difficult for some users to locate. For example, the portion, e.g., button, may not be a dedicated commissioning button (for example, commissioning may be a secondary function of the button or key, and the button or key may be more prominently labelled with a primary function thereof) and/or the button may not be conspicuously located on the household appliance. As another example, the portion of the user interface which a user is required to touch may vary from one appliance to another, such as different models of the same type of appliance may have a commissioning button in different locations.

Accordingly, there exists a need for an appliance which can be connected to a secured wireless network and added to a user account in an easier and more convenient manner.

BRIEF DESCRIPTION OF THE INVENTION

Aspects and advantages of the invention will be set forth in part in the following description, or may be obvious from the description, or may be learned through practice of the invention.

In accordance with one embodiment of the present disclosure, a method of provisioning a household appliance is provided. The method includes transmitting a signal from the household appliance to a remote user interface device and receiving, by the household appliance, an acknowledgement from the remote user interface device in response to the signal. The method further includes providing an indication on a user interface physically connected to the household appliance. The indication indicates an element of the user interface physically connected to the household appliance to select in order to cause the household appliance to enter commissioning mode.

In accordance with another embodiment of the present disclosure, a household appliance is provided. The household appliance includes a controller. The controller is configured for transmitting a signal from the household appliance to a remote user interface device and receiving an acknowledgement from the remote user interface device in response to the signal. The controller is further configured for providing an indication on a user interface physically connected to the household appliance. The indication indicates which element of the user interface physically connected to the household appliance to select in order to cause the household appliance to enter commissioning mode.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
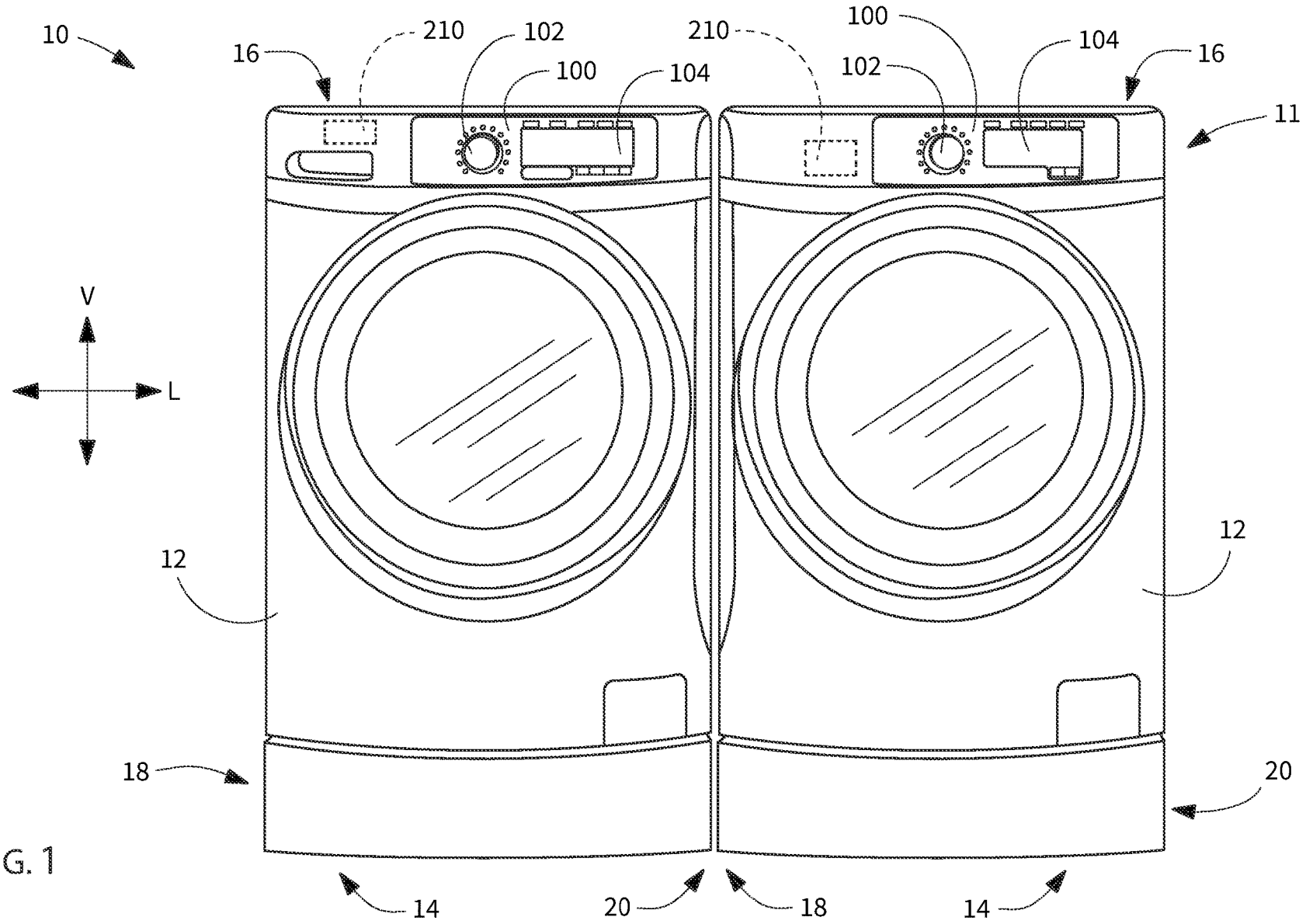
FIG. 1 provides a front view of an exemplary washing machine appliance and an exemplary dryer appliance in accordance with one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

As may be seen in FIGS. 1 through 5, in accordance with one or more embodiments of the present subject matter, a household appliance is provided. Specific examples of such household appliances are each described in turn below to illustrate various aspects and embodiments of the present disclosure. However, it should be understood that such examples are non-limiting and the household appliance of the present disclosure may include a variety of appliances with various features operable to perform household and/or domestic tasks.

Figure 2:
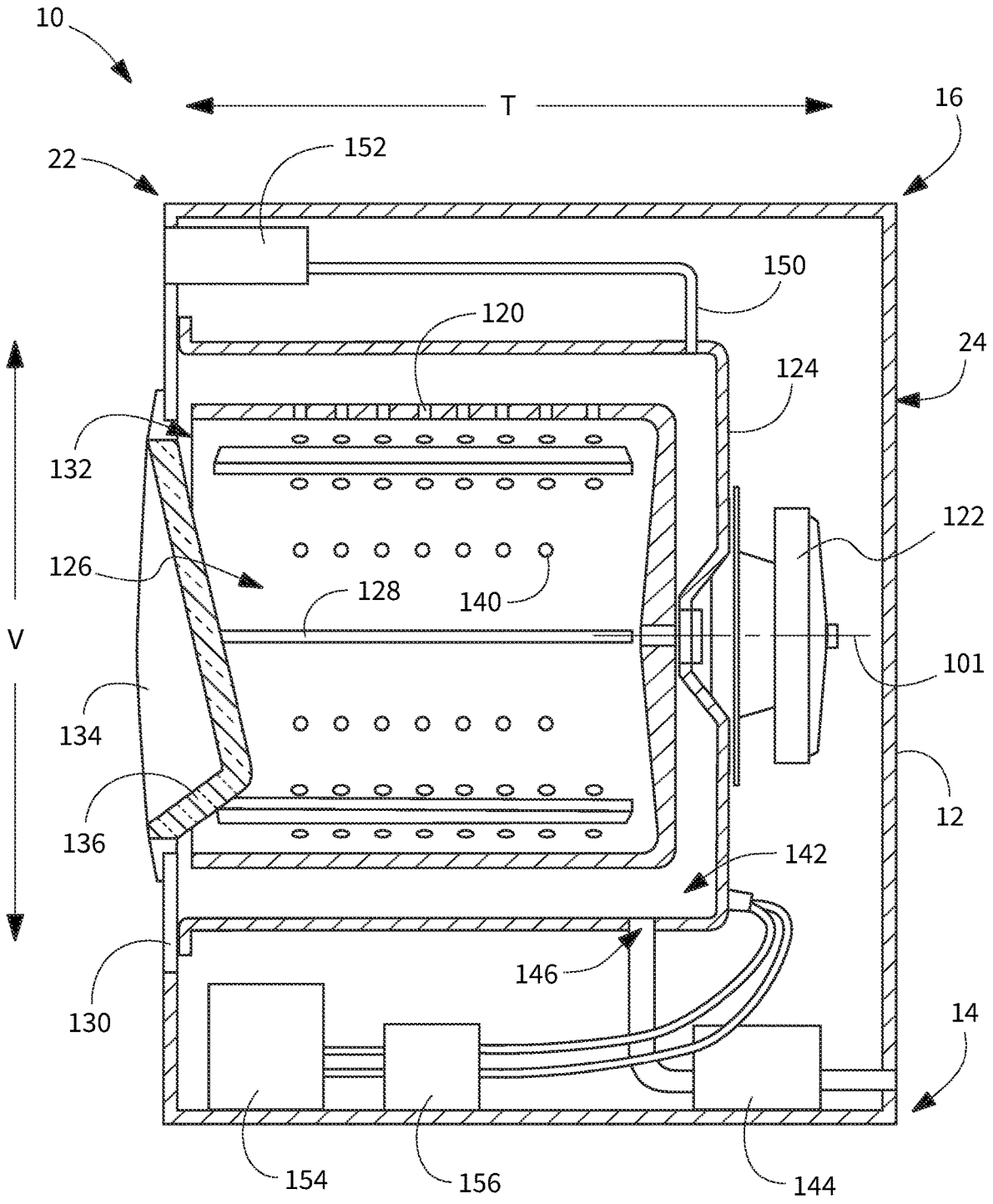
FIG. 2 provides a transverse cross-sectional view of the exemplary washing machine appliance of FIG. 1.
Figure 3:
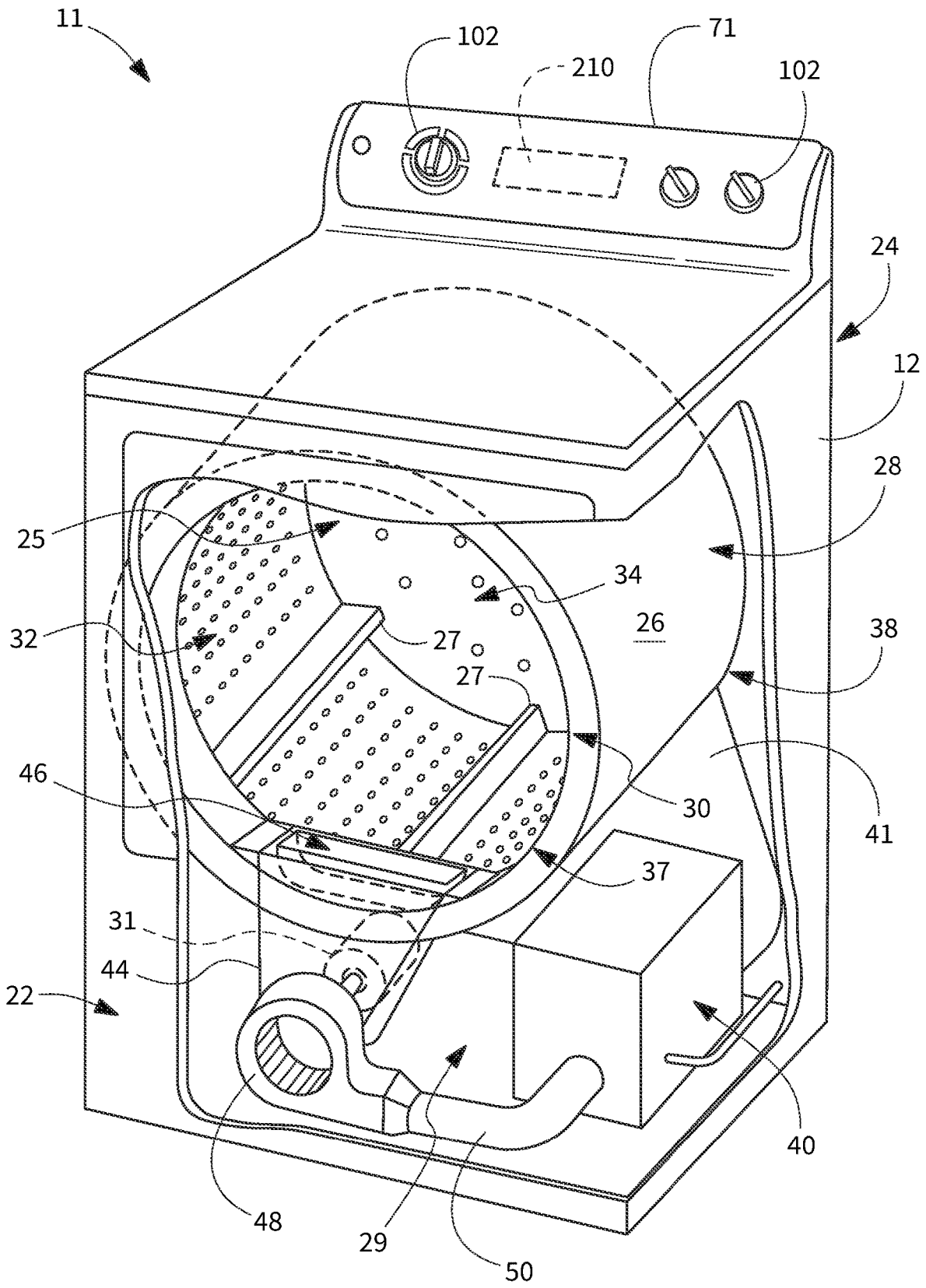
FIG. 3 provides a perspective view of the exemplary dryer appliance of FIG. 1 with portions of a cabinet of the dryer appliance removed to reveal certain components of the dryer appliance.

It should be understood that "household appliance" and/or "appliance" are used herein to describe appliances typically used or intended for common domestic tasks, such as a laundry appliance, e.g., as illustrated in FIGS. 1 through 3, or a dishwasher appliance (see, e.g., FIGS. 4 and 5), an oven appliance, a refrigerator, a water heater, etc., and any other household appliance which performs similar functions in addition to network communication and data processing. Thus, devices such as a personal computer, router, and other similar devices the primary functions of which are network communication and/or data processing are not considered household appliances as used herein.

As may be seen generally throughout FIGS. 1 through 5, a user interface panel 100 and a user input device 102 may be positioned on an exterior of the appliance. The user input device 102 is generally positioned proximate to the user interface panel 100, and in some embodiments, the user input device 102 may be positioned on the user interface panel 100.

In various embodiments, the user interface panel 100 may represent a general purpose I/O ("GPIO") device or functional block. In some embodiments, the user interface panel 100 may include or be in operative communication with user input device 102, such as one or more of a variety of digital, analog, electrical, mechanical or electro-mechanical input devices including rotary dials, control knobs, push buttons, and touch pads. The user interface panel 100 may include a display component 104, such as a digital or analog display device designed to provide operational feedback to a user. The display component 104 may also be a touchscreen capable of receiving a user input, such that the display component 104 may also be a user input device in addition to or instead of the user input device 102.

Generally, the appliance may include a controller 210 in operative communication with the user input device 102. The user interface panel 100 and the user input device 102 may be in communication with the controller 210 via, for example, one or more signal lines or shared communication busses. Input/output ("I/O") signals may be routed between controller 210 and various operational components of the appliance. Operation of the appliance can be regulated by the controller 210 that is operatively coupled to the user interface panel 100. A user interface panel 100 may for example provide selections for user manipulation of the operation of an appliance, e.g., via user input device 102 and/or display 104. In response to user manipulation of the user interface panel 100 and/or user input device 102, the controller 210 may operate various components of the appliance. Controller 210 may include a memory and one or more microprocessors, CPUs or the like, such as general or special purpose microprocessors operable to execute programming instructions or micro-control code associated with operation of the appliance. The memory may represent random access memory such as DRAM, or read only memory such as ROM or FLASH. In one embodiment, the processor executes programming instructions stored in memory. The memory may be a separate component from the processor or may be included onboard within the processor. Alternatively, a controller 210 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 210 may be programmed to operate the appliance by executing instructions stored in memory. For example, the instructions may be software or any set of instructions that when executed by the processing device, cause the processing device to perform operations. Controller 210 can include one or more processor(s) and associated memory device(s) configured to perform a variety of computer-implemented functions and/or instructions (e.g. performing the methods, steps, calculations and the like and storing relevant data as disclosed herein). It should be noted that controllers 210 as disclosed herein are capable of and may be operable to perform any methods and associated method steps as disclosed herein.

In some embodiments, for example, as illustrated in FIG. 1, either appliance or both appliances of a pair of laundry appliances 10 and 11 may be the household appliance. In embodiments such as illustrated in FIG. 1, the user input device 102 of each appliance 10 and 11 may be positioned on the user interface panel 100. The embodiment illustrated in FIG. 1 also includes a display 104 on the user interface panel 100 of each household appliance 10 and 11.

As generally seen throughout FIGS. 1 through 3, in at least some embodiments, each appliance 10 and 11 includes a cabinet 12 which defines a vertical direction V and a lateral direction L that are mutually perpendicular. Each cabinet 12 extends between a top side 16 and a bottom side 14 along the vertical direction V. Each cabinet 12 also extends between a left side 18 and a right side 20, e.g., along the lateral direction L.

Additional exemplary details of the laundry appliances are illustrated in FIGS. 2 and 3. For example, FIG. 2 provides a cross-sectional view of the exemplary washing machine appliance 10. As illustrated in FIG. 2, a wash tub 124 is non-rotatably mounted within cabinet 12. As may be seen in FIG. 2, the wash tub 124 defines a central axis 101. In the example embodiment illustrated by FIG. 2, the central axis 101 may be oriented generally along or parallel to the transverse direction T of the washing machine appliance 10. Accordingly, the washing machine appliance 10 may be referred to as a horizontal axis washing machine.

Referring again to FIG. 2, a wash basket 120 is rotatably mounted within the tub 124 such that the wash basket 120 is rotatable about an axis of rotation, which generally coincides with central axis 101 of the tub 124. A motor 122, e.g., such as a pancake motor, is in mechanical communication with wash basket 120 to selectively rotate wash basket 120 (e.g., during an agitation or a rinse cycle of washing machine appliance 10). Wash basket 120 defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. The wash basket 120 and the tub 124 may collectively define at least a portion of a tub assembly for the washing machine appliance 10.

Wash basket 120 may define one or more agitator features that extend into wash chamber 126 to assist in agitation and cleaning of articles disposed within wash chamber 126 during operation of washing machine appliance 10. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 12 also includes a front panel 130 which defines an opening 132 that permits user access to wash basket 120 within wash tub 124. More specifically, washing machine appliance 10 includes a door 134 that is positioned in front of opening 132 and is rotatably mounted to front panel 130. Door 134 is rotatable such that door 134 permits selective access to opening 132 by rotating between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 10. Door 134 also includes a handle (not shown) that, e.g., a user may pull when opening and closing door 134. Further, although door 134 is illustrated as mounted to front panel 130, it should be appreciated that door 134 may be mounted to another side of cabinet 12 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 10. For example, during operation of washing machine appliance 10, wash fluid may be urged by gravity from basket 120 to sump 142 through plurality of perforations 140. A pump assembly 144 is located beneath tub 124 for gravity assisted flow when draining tub 124, e.g., via a drain 146. Pump assembly 144 may be configured for recirculating wash fluid within wash tub 124.

A spout 150 is configured for directing a flow of fluid into wash tub 124. For example, spout 150 may be in fluid communication with a water supply (not shown) in order to direct fluid (e.g., clean water) into wash tub 124. Spout 150 may also be in fluid communication with the sump 142. For example, pump assembly 144 may direct wash fluid disposed in sump 142 to spout 150 in order to circulate wash fluid in wash tub 124.

As illustrated in FIG. 2, a detergent drawer 152 is slidably mounted within front panel 130. Detergent drawer 152 receives a wash additive (e.g., detergent, fabric softener, bleach, or any other suitable liquid or powder) and directs the fluid additive to wash chamber 124 during operation of washing machine appliance 10. According to the illustrated embodiment, detergent drawer 152 may also be fluidly coupled to spout 150 to facilitate the complete and accurate dispensing of wash additive.

Additionally, a bulk reservoir 154 is disposed within cabinet 12. Bulk reservoir 154 is also configured for receipt of fluid additive for use during operation of washing machine appliance 10. Bulk reservoir 154 is sized such that a volume of fluid additive sufficient for a plurality or multitude of wash cycles of washing machine appliance 10 (e.g., five, ten, twenty, fifty, or any other suitable number of wash cycles) may fill bulk reservoir 154. Thus, for example, a user can fill bulk reservoir 154 with fluid additive and operate washing machine appliance 10 for a plurality of wash cycles without refilling bulk reservoir 154 with fluid additive. A reservoir pump 156 is configured for selective delivery of the fluid additive from bulk reservoir 154 to wash tub 124.

During operation of washing machine appliance 10, laundry items are loaded into wash basket 120 through opening 132, and washing operation is initiated through operator manipulation of input selectors 102. Wash tub 124 is filled with water, detergent, and/or other fluid additives, e.g., via spout 150 and/or detergent drawer 152. One or more valves (not shown) can be controlled by washing machine appliance 10 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a spin cycle, basket 120 is rotated at relatively high speeds. After articles disposed in wash basket 120 are cleaned and/or washed, the user can remove the articles from wash basket 120, e.g., by opening door 134 and reaching into wash basket 120 through opening 132.

While described in the context of a specific embodiment of horizontal axis washing machine appliance 10, using the teachings disclosed herein it will be understood that horizontal axis washing machine appliance 10 is provided by way of example only. It should be appreciated that the present subject matter is not limited to any particular style, model, or configuration of washing machine appliance. Other washing machine appliances having different configurations, different appearances, and/or different features may also be utilized with the present subject matter as well, e.g., vertical axis washing machine appliances.

FIG. 3 provides a perspective view of the dryer appliance 11 of FIG. 1, which is an example embodiment of a household appliance, with a portion of a cabinet or housing 12 of dryer appliance 11 removed in order to show certain components of dryer appliance 11. Dryer appliance 11 generally defines a vertical direction V, a lateral direction L, and a transverse direction T, each of which is mutually perpendicular, such that an orthogonal coordinate system is defined. While described in the context of a specific embodiment of dryer appliance 11, using the teachings disclosed herein, it will be understood that dryer appliance 11 is provided by way of example only. Other dryer appliances having different appearances and different features may also be utilized with the present subject matter as well.

Cabinet 12 includes a front side 22 and a rear side 24 spaced apart from each other along the transverse direction T. Within cabinet 12, an interior volume 29 is defined. A drum or container 26 is mounted for rotation about a substantially horizontal axis within the interior volume 29. Drum 26 defines a chamber 25 for receipt of articles of clothing for tumbling and/or drying. Drum 26 extends between a front portion 37 and a back portion 38. Drum 26 also includes a back or rear wall 34, e.g., at back portion 38 of drum 26. A supply duct 41 may be mounted to rear wall 34 and receives heated air that has been heated by a heating assembly or system 40.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 11 (e.g., clothes dryer) and may include a mixture of different or similar articles of clothing of different or similar types and kinds of fabrics, textiles, garments and linens within a particular laundering process.

A motor 31 is provided in some embodiments to rotate drum 26 about the horizontal axis, e.g., via a pulley and a belt (not pictured). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles 27 are provided within chamber 25 of drum 26 to lift articles therein and then allow such articles to tumble back to a bottom of drum 26 as drum 26 rotates. Baffles 27 may be mounted to drum 26 such that baffles 27 rotate with drum 26 during operation of dryer appliance 11.

The rear wall 34 of drum 26 may be rotatably supported within the cabinet 12 by a suitable fixed bearing. Rear wall 34 can be fixed or can be rotatable. Rear wall 34 may include, for instance, a plurality of holes that receive hot air that has been heated by heating system 40. The heating system 40 may include, e.g., a heat pump, an electric heating element, and/or a gas heating element (e.g., gas burner). Moisture laden, heated air is drawn from drum 26 by an air handler, such as blower fan 48, which generates a negative air pressure within drum 26. The moisture laden heated air passes through a duct 44 enclosing screen filter 46, which traps lint particles. As the air passes from blower fan 48, it enters a duct 50 and then is passed into heating system 40. In some embodiments, the dryer appliance 11 may be a conventional dryer appliance, e.g., the heating system 40 may be or include an electric heating element, e.g., a resistive heating element, or a gas-powered heating element, e.g., a gas burner. In other embodiments, the dryer appliance may be a condensation dryer, such as a heat pump dryer. In such embodiments, heating system 40 may be or include a heat pump including a sealed refrigerant circuit. Heated air (with a lower moisture content than was received from drum 26), exits heating system 40 and returns to drum 26 by duct 41. After the clothing articles have been dried, they are removed from the drum 26 via opening 32. A door (FIG. 1) provides for closing or accessing drum 26 through opening 32.

In some embodiments, one or more selector inputs 102, such as knobs, buttons, touchscreen interfaces, etc., may be provided or mounted on the cabinet 12 (e.g., on a backsplash 71) and are in operable communication (e.g., electrically coupled or coupled through a wireless network band) with the processing device or controller 210. Controller 210 may also be provided in operable communication with components of the dryer appliance 11 including motor 31, blower 48, or heating system 40. In turn, signals generated in controller 210 direct operation of motor 31, blower 48, or heating system 40 in response to the position of inputs 102. As used herein, "processing device" or "controller" may refer to one or more microprocessors, microcontroller, ASICS, or semiconductor devices and is not restricted necessarily to a single element. The controller 210 may be programmed to operate dryer appliance 11 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controllers as disclosed herein are capable of and may be operable to perform any methods and associated method steps as disclosed herein. For example, in some embodiments, methods disclosed herein may be embodied in programming instructions stored in the memory and executed by the controller 210.

Figure 4:
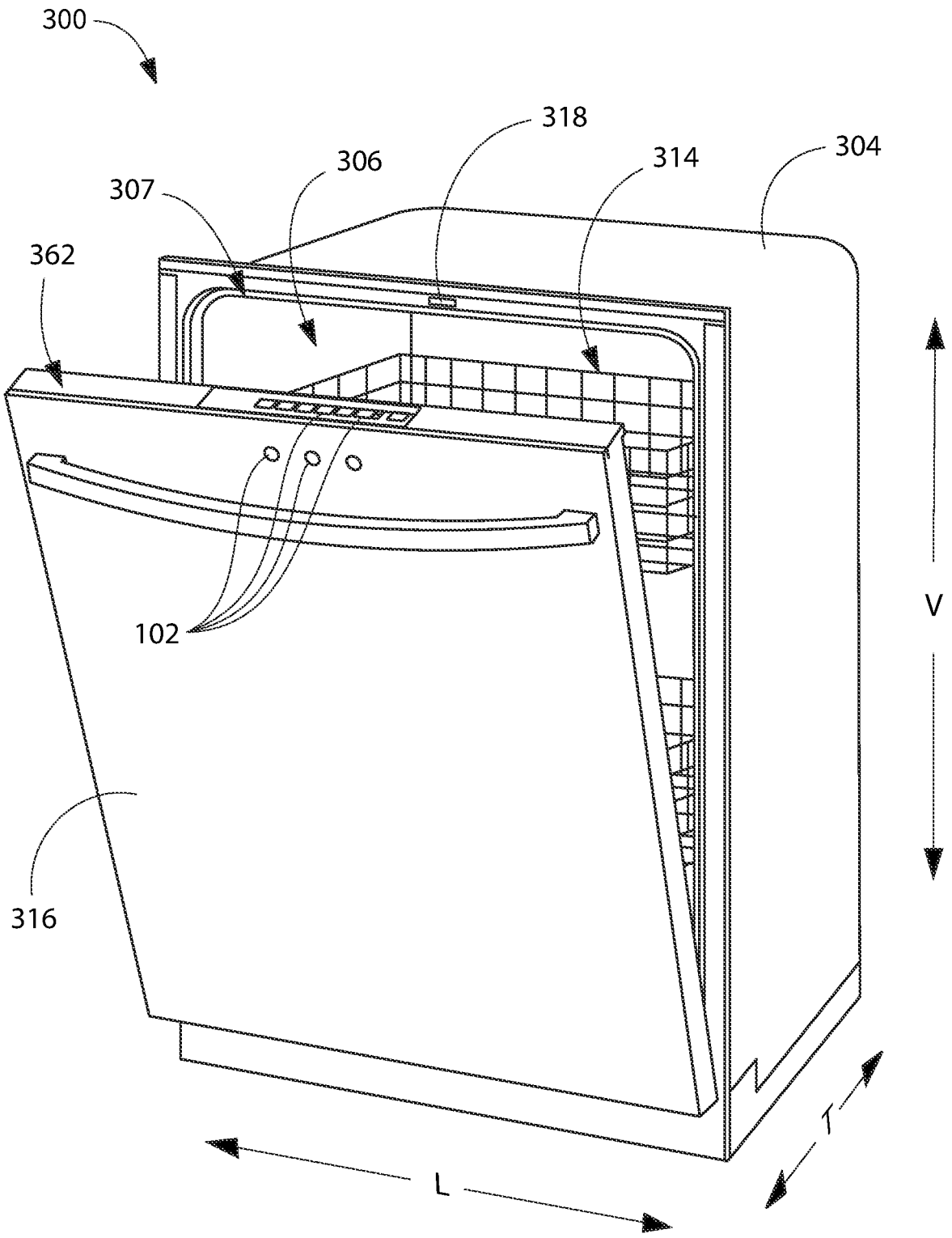
FIG. 4 provides a front view of a dishwashing appliance in accordance with additional embodiments of the present disclosure.
Figure 5:
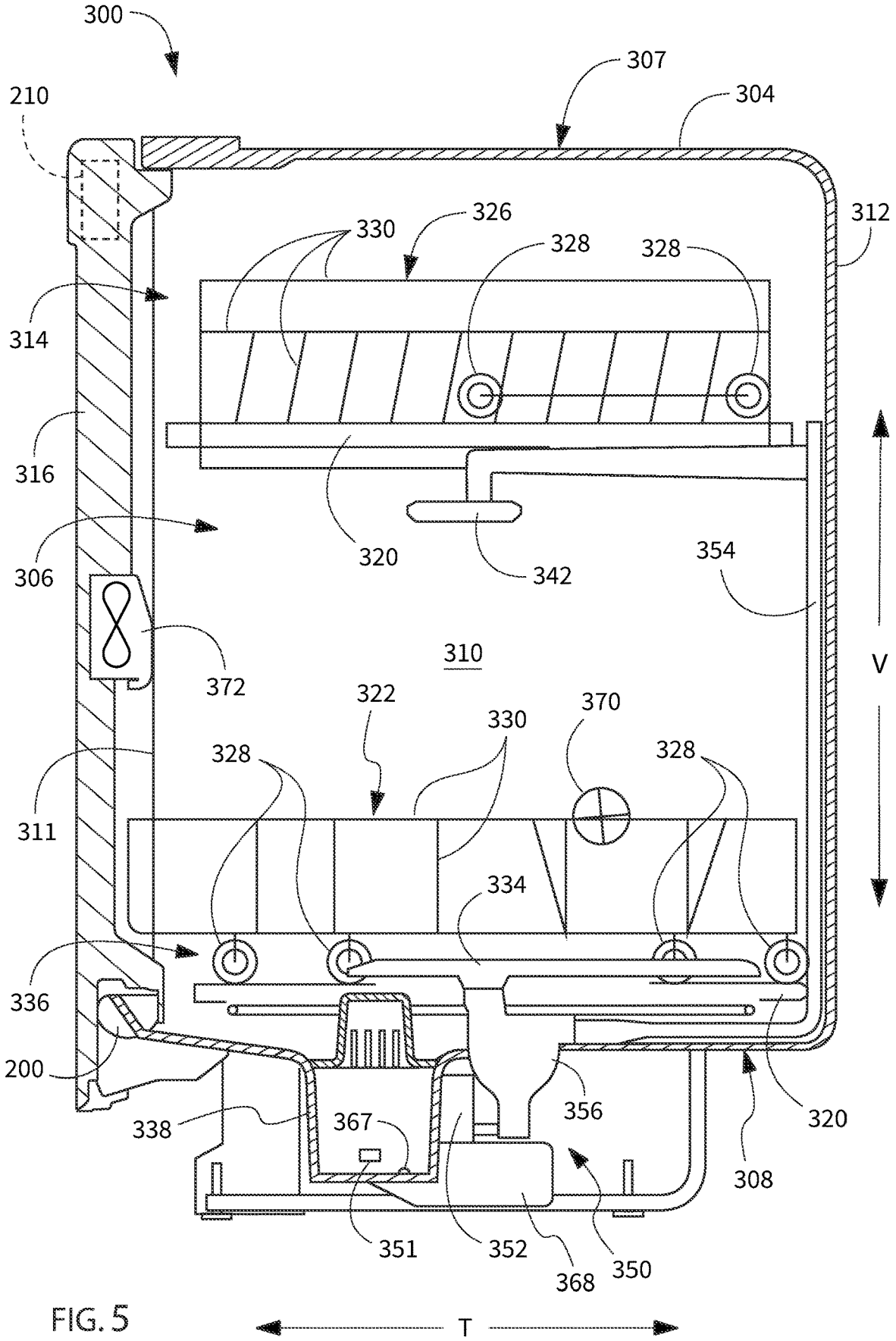
FIG. 5 provides a transverse cross-sectional view of the dishwashing appliance of FIG. 4.

Turning now to FIGS. 4 and 5, in some embodiments, the household appliance may be a dishwasher or dishwashing appliance, such as the exemplary dishwashing appliance 300, that may be configured in accordance with aspects of the present disclosure. Generally, dishwasher 300 defines a vertical direction V, a lateral direction L, and a transverse direction T. Each of the vertical direction V, lateral direction L, and transverse direction T are mutually perpendicular to one another and form an orthogonal direction system.

Dishwasher 300 includes a tub 304 that defines a wash chamber 306 therein. As shown in FIG. 5, tub 304 extends between a top 307 and a bottom 308 along the vertical direction V, between a pair of side walls 310 along the lateral direction L, and between a front side 311 and a rear side 312 along the transverse direction T.

Tub 304 includes a front opening 314 at the front side 311. In some embodiments, the dishwashing appliance 300 may also include a door 316 at the front opening 314. The door 316 may, for example, be coupled to the tub 304 by a hinge 200 at its bottom for movement between a normally closed vertical position (FIG. 5), wherein the wash chamber 306 is sealed shut for washing operation, and a horizontal open position (not shown, while a partially open position is illustrated in FIG. 4) for loading and unloading of articles from dishwasher 300. A door closure mechanism or assembly 318, e.g., a latch, may be provided to lock and unlock door 316 for accessing and sealing wash chamber 306.

In exemplary embodiments, tub side walls 310 accommodate a plurality of rack assemblies. For instance, guide rails 320 may be mounted to side walls 310 for supporting a lower rack assembly 322 and an upper rack assembly 326. In some such embodiments, upper rack assembly 326 is positioned at a top portion of wash chamber 306 above lower rack assembly 322 along the vertical direction V.

Generally, each rack assembly 322, 326 may be adapted for movement between an extended loading position (not shown) in which the rack is substantially positioned outside the wash chamber 306, and a retracted position (shown in FIG. 5) in which the rack is located inside the wash chamber 306. In some embodiments, movement is facilitated, for instance, by rollers 328 mounted onto rack assemblies 322, 326, respectively.

Although guide rails 320 and rollers 328 are illustrated herein as facilitating movement of the respective rack assemblies 322, 326, it should be appreciated that any suitable sliding mechanism or member may be used according to alternative embodiments.

In optional embodiments, some or all of the rack assemblies 322, 326 are fabricated into lattice structures including a plurality of wires or elongated members 330 (for clarity of illustration, not all elongated members making up rack assemblies 322, 326 are shown). In this regard, rack assemblies 322, 326 are generally configured for supporting articles within wash chamber 306 while allowing a flow of wash liquid to reach and impinge on those articles (e.g., during a cleaning or rinsing cycle). According to additional or alternative embodiments, a silverware basket (not shown) may be removably attached to a rack assembly (e.g., lower rack assembly 322), for placement of silverware, utensils, and the like, that are otherwise too small to be accommodated by the rack assembly.

Generally, dishwasher 300 includes one or more spray assemblies for urging a flow of fluid (e.g., wash liquid) onto the articles placed within wash chamber 306.

In exemplary embodiments, dishwasher 300 includes a lower spray arm assembly 334 disposed in a lower region 336 of wash chamber 306 and above a sump 338 so as to rotate in relatively close proximity to lower rack assembly 322. In this regard, lower spray arm assembly 334 may generally be configured for urging a flow of wash liquid up through lower rack assembly 322.

In some embodiments, an upper spray assembly 342 may be located proximate to and, e.g., below, upper rack assembly 326 along the vertical direction V. In this manner, upper spray assembly 342 may be generally configured for urging of wash liquid up through upper rack assembly 326.

The various spray assemblies and manifolds described herein may be part of a fluid distribution system or fluid circulation assembly 350 for circulating wash liquid in tub 304. In certain embodiments, fluid circulation assembly 350 includes a circulation pump 352 for circulating wash liquid in tub 304. Circulation pump 352 may be mounted to sump 338 and in fluid communication with the sump 338 through a circulation outlet 351 from the sump 338.

When assembled, circulation pump 352 may be in fluid communication with an external water supply line (not shown) and sump 338. A water inlet valve (not shown) can be positioned between the external water supply line and circulation pump 352 (e.g., to selectively allow water to flow from the external water supply line to circulation pump 352). Additionally or alternatively, water inlet valve can be positioned between the external water supply line and sump 338 (e.g., to selectively allow water to flow from the external water supply line to sump 338). During use, water inlet valve may be selectively controlled to open to allow the flow of water into dishwasher 300 and may be selectively controlled to close and thereby cease the flow of water into dishwasher 300. Further, fluid circulation assembly 350 may include one or more fluid conduits or circulation piping for directing wash fluid from circulation pump 352 to the various spray assemblies and manifolds. In exemplary embodiments, such as that shown in FIG. 5, a primary supply conduit 354 extends from circulation pump 352, along rear side 312 of tub 304 along the vertical direction V to supply wash liquid throughout wash chamber 306.

In optional embodiments, circulation pump 352 urges or pumps wash liquid to a diverter 356 (FIG. 5). In some such embodiments, diverter 356 is positioned within sump 338 of dishwashing appliance 300). Diverter 356 may include a diverter disk (not shown) disposed within a diverter chamber 358 for selectively distributing the wash liquid to the spray assemblies 334, 342, or other spray manifolds or assemblies. For instance, the diverter disk may have at least one aperture configured to align with one or more outlet ports (not shown) at the top of diverter chamber 358. In this manner, the diverter disk may be selectively rotated to provide wash liquid to the desired spray device(s).

In exemplary embodiments, diverter 356 is configured for selectively distributing the flow of wash liquid from circulation pump 352 to various fluid supply conduits—only some of which are illustrated in FIG. 5 for clarity. In certain embodiments, diverter 356 includes two or more outlet ports (not shown) for supplying wash liquid to a first conduit for rotating lower spray arm assembly 334 and a second conduit for supplying upper spray assembly 342 (e.g., supply conduit 354). Additional embodiments may also include one or more additional conduits, e.g., a third conduit for spraying an auxiliary rack such as a silverware rack, etc.

In some embodiments, a supply conduit 354 is used to supply wash liquid to one or more spray assemblies (e.g., to upper spray assembly 342). It should be appreciated, however, that according to alternative embodiments, any other suitable plumbing configuration may be used to supply wash liquid throughout the various spray manifolds and assemblies described herein. For instance, according to another exemplary embodiment, supply conduit 354 could be used to provide wash liquid to lower spray arm assembly 334 and a dedicated secondary supply conduit (not shown) could be utilized to provide wash liquid to upper spray assembly 342. Other plumbing configurations may be used for providing wash liquid to the various spray devices and manifolds at any location within dishwashing appliance 300.

Each spray assembly 334 and 342, or other spray device as may be included in dishwashing appliance 300, may include an arrangement of discharge ports or orifices for directing wash liquid received from circulation pump 352 onto dishes or other articles located in wash chamber 306. The arrangement of the discharge ports, also referred to as jets, apertures, or orifices, may provide a rotational force by virtue of wash liquid flowing through the discharge ports. Alternatively, spray assemblies 334, 342 may be motor-driven, or may operate using any other suitable drive mechanism. Spray manifolds and assemblies may also be stationary. The resultant movement of the spray assemblies 334, 342 and the spray from fixed manifolds provides coverage of dishes and other dishwasher contents with a washing spray. Other configurations of spray assemblies may be used as well. For instance, dishwasher 300 may have additional spray assemblies for cleaning silverware, for scouring casserole dishes, for spraying pots and pans, for cleaning bottles, etc.

Drainage of soiled wash liquid within sump 338 may by provided, for instance, by a drain pump 368 (e.g., during or as part of a drain cycle). In particular, wash liquid may exit sump 338 through a drain outlet 367 and may flow through a drain conduit or directly to the drain pump 368. Thus, drain pump 368 is downstream of sump 338 and facilitates drainage of the soiled wash liquid by urging or pumping the wash liquid to a drain line external to dishwasher 300.

In some embodiments, a filter assembly may be provided, e.g., in the sump 338 and/or at a top entrance into the sump 338, e.g., to filter fluid to circulation assembly 350 and/or drain pump 368. Generally, the filter assembly removes soiled particles from the liquid that flows to the sump 338 from the wash chamber 306 during operation of dishwashing appliance 300. In exemplary embodiments, the filter assembly may include both a first filter (also referred to as a "coarse filter") and a second filter (also referred to as a "fine filter").

Although a separate circulation pump 352 and drain pump 368 are described herein, it is understood that other suitable pump configurations (e.g., using only a single pump for both recirculation and draining) may be provided.

Dishwashing appliance 300 may also include ventilation features, e.g., to promote improved, e.g., more rapid, drying of articles therein after the wash and rinse cycles. For example, one or more vents 370 may be provided in the tub 304 for introducing relatively dry air from outside of the tub 304 into the wash chamber 306 and/or for removing relatively humid air from the wash chamber 306 to the outside of the tub 304. In some embodiments, a fan 372 may be provided. The fan 372 may be operable to urge air through the wash chamber 306, such as to promote air circulation and/or ventilation within and through the wash chamber. Such air movement may increase the rate of evaporation of moisture from articles in the wash chamber 306 after a wash and/or rinse cycle.

In certain embodiments, dishwasher 300 includes a controller 210 configured to regulate operation of dishwasher 300 (e.g., initiate one or more wash operations). Controller 210 may include one or more memory devices and one or more microprocessors, etc., as described above. It should be noted that controllers as disclosed herein are capable of and may be operable to perform any methods and associated method steps as disclosed herein.

Controller 210 may be positioned in a variety of locations throughout dishwasher 300. In optional embodiments, controller 210 is located within a control panel area 362 of door 316 (e.g., as shown in FIG. 4). Input/output ("I/O") signals may be routed between the control system and various operational components of dishwasher 300 along wiring harnesses that may be routed through the bottom of door 316. Typically, the controller 210 includes or is operatively coupled to a user interface panel/controls 102 through which a user may select various operational features and modes and monitor progress of dishwasher 300. In some embodiments, the user interface includes a general purpose I/O ("GPIO") device or functional block. In additional or alternative embodiments, user interface includes input components, such as one or more of a variety of electrical, mechanical or electro-mechanical input devices including rotary dials, push buttons, and touch pads. In further additional or alternative embodiments, the user interface may include a display component, such as a digital or analog display device designed to provide operational feedback to a user. When assembled, the user interface may be in operative communication with the controller 210 via one or more signal lines or shared communication busses.

It should be appreciated that the invention is not limited to any particular style, model, or configuration of dishwasher 300. The exemplary embodiments depicted in FIGS. 4 and 5 are for illustrative purposes only. For instance, different locations may be provided for user input devices 102, different configurations may be provided for rack assemblies 322, 326, different spray assemblies 334, 342 and spray manifold configurations may be used, different sensors may be used, and other differences may be applied while remaining within the scope of the present disclosure.

According to various embodiments of the present disclosure, a household appliance may take the form of any of the examples described above, or may be any other household appliance where commissioning the appliance to a network may be desired. Thus, it will be understood that the present subject matter is not limited to any particular household appliance.

Figure 6:
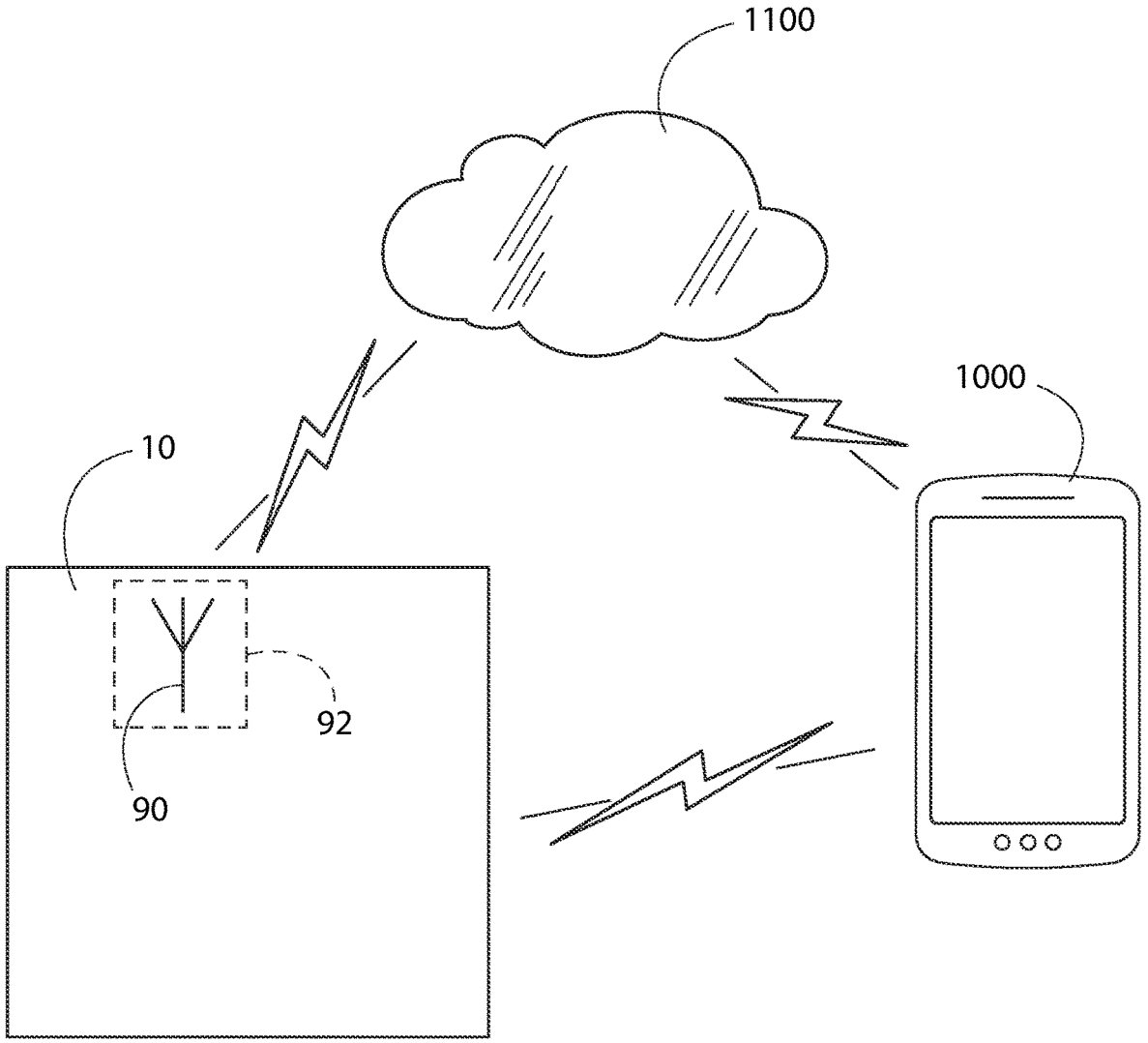
FIG. 6 provides a schematic diagram of an appliance in communication with a remote user interface device and a remote database according to one or more embodiments of the present disclosure.

Turning now to FIG. 6, a general schematic of a household appliance, generally designated by reference number 10 (without intending to limit the appliance 10 of FIG. 6 to any particular household appliance, e.g., the appliance 10 of FIG. 6 may be the washing machine 10 described above which is one example embodiment of a household appliance, but the appliance 10 of FIG. 6 is not limited to that particular example) and communication features thereof. FIG. 6 schematically illustrates an appliance 10, which may be, for example, one of the laundry appliances 10 or 11 of FIGS. 1 through 3, or the dishwashing appliance 300 of FIGS. 4 and 5, among other possible example household appliances, which communicates wirelessly with a remote user interface device 1000. For example, as illustrated in FIG. 6, the household appliance 10 may include an antenna 90 by which the household appliance 10 communicates with, e.g., sends and receives signals to and from, the remote user interface device 1000. The antenna 90 may be part of, e.g., onboard, a communications module 92. The communications module 92 may be a wireless communications module operable to connect wirelessly, e.g., over the air, to one or more other devices via any suitable wireless communication protocol. For example, the communications module 92 may be a WI-FI® module, a BLUETOOTH® module, or a combination module providing both WI-FI® and BLUETOOTH® connectivity. The remote user interface device 1000 may be a laptop computer, smartphone, tablet, personal computer, wearable device, smart home system, and/or various other suitable devices.

The appliance 10 may be in communication with the remote user interface device 1000 device through various possible communication connections and interfaces. The appliance 10 and the remote user interface device 1000 may be matched in wireless communication, e.g., connected to the same wireless network. The appliance 10 may communicate with the remote user interface device 1000 via short-range radio such as BLUETOOTH® or any other suitable wireless network having a layer protocol architecture. As used herein, "short-range" may include ranges less than about ten meters and up to about one hundred meters. For example, the wireless network may be adapted for short-wavelength ultra-high frequency (UHF) communications in a band between 2.4 GHz and 2.485 GHz (e.g., according to the IEEE 802.15.1 standard). In particular, BLUETOOTH® Low Energy, e.g., BLUETOOTH® Version 4.0 or higher, may advantageously provide short-range wireless communication between the appliance 10 and the remote user interface device 1000. For example, BLUETOOTH® Low Energy may advantageously minimize the power consumed by the exemplary methods and devices described herein due to the low power networking protocol of BLUETOOTH® Low Energy.

The remote user interface device 1000 is "remote" at least in that it is spaced apart from and not physically connected to the appliance 10, e.g., the remote user interface device 1000 is a separate, stand-alone device from the appliance 10 which communicates with the appliance 10 wirelessly. Any suitable device separate from the appliance 10 that is configured to provide and/or receive communications, information, data, or commands from a user may serve as the remote user interface device 1000, such as a smartphone (e.g., as illustrated in FIG. 6), smart watch, personal computer, smart home system, or other similar device. For example, the remote user interface device 1000 may be a smartphone operable to store and run applications, also known as "apps," and some or all of the method steps disclosed herein may be performed by a smartphone app.

The remote user interface device 1000 may include a memory for storing and retrieving programming instructions. Thus, the remote user interface device 1000 may provide a remote user interface which may be an additional user interface to the user interface panel 100. For example, the remote user interface device 1000 may be a smartphone operable to store and run applications, also known as "apps," and the remote user interface may be provided as a smartphone app.

As mentioned above, the appliance 10 may also be configured to communicate wirelessly with a network 1100. The network 1100 may be, e.g., a cloud-based data storage system. For example, the appliance 10 may communicate with the network 1100 over the Internet, which the appliance 10 may access via WI-FI®, such as from a WI-FI® access point in a user's home. For example, the household appliance 10 may be provisioned, e.g., set up for access to and initially connected to, to the network 1100 via the remote user interface device 1000.

Figure 7:
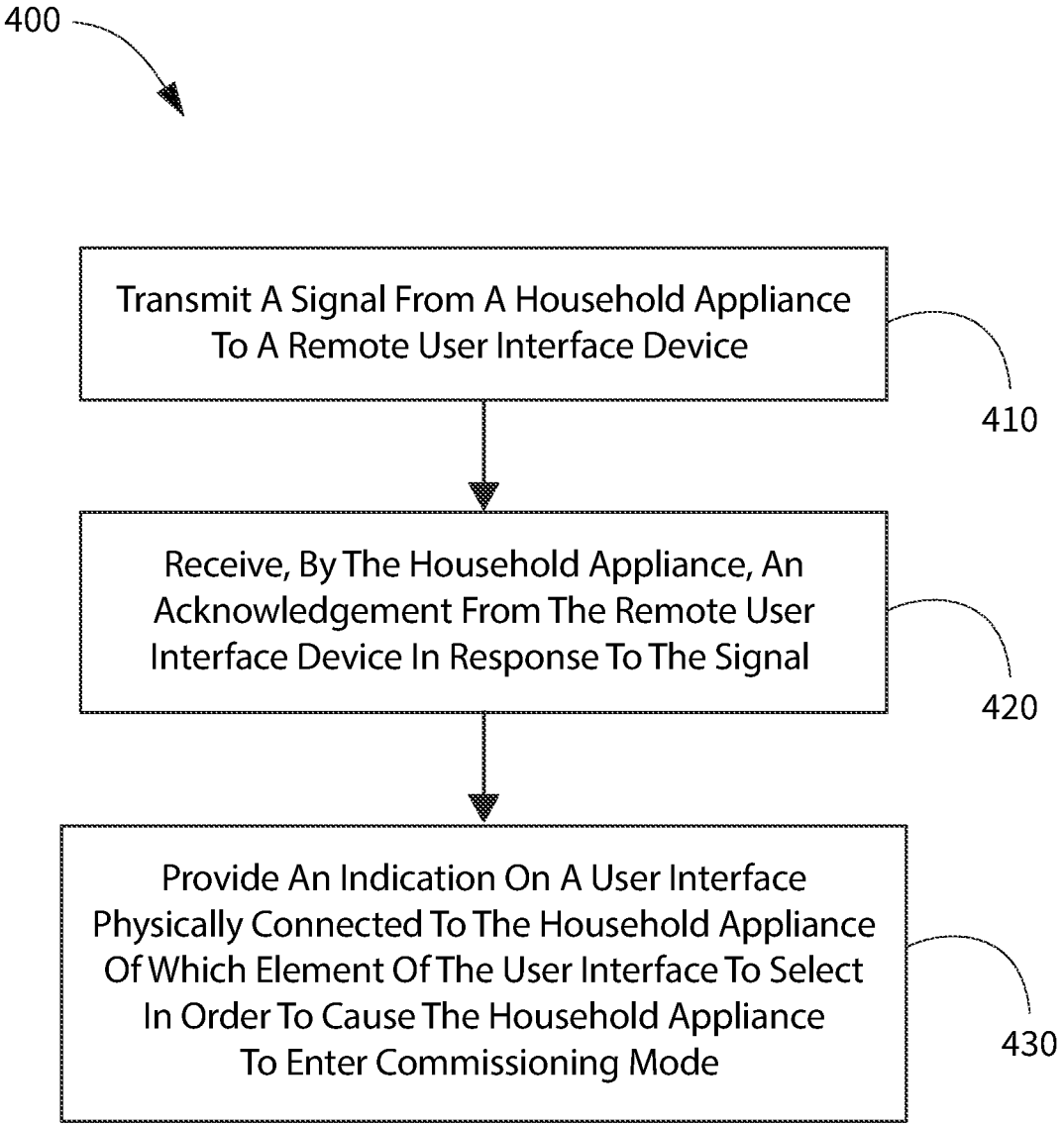
FIG. 7 provides a flowchart illustrating an example method of provisioning a household appliance according to one or more example embodiments of the present disclosure.

Embodiments of the present disclosure also include methods of operating, e.g., provisioning, a household appliance. Exemplary methods according to the present subject matter include the method 400 of provisioning a household appliance illustrated in FIG. 7. As illustrated in FIG. 7, the method 400 may include a step 410 of transmitting a signal from the household appliance to a remote user interface device. In some embodiments, the transmitted signal from the household appliance may be or include a low-energy short-range radio signal. For example, the transmitted signal from the household appliance may be or include a broadcast message, such as a BLUETOOTH® Low Energy beacon, e.g., a non-connectable advertisement. The transmitted signal from the household appliance may include identifying information of the household appliance, e.g., a model name and/or model number. For example, the identifying information may be encoded in the transmitted signal from the household appliance.

Method 400 may further include a step 420 of receiving, by the household appliance, an acknowledgement from the remote user interface device in response to the signal. The response, e.g., acknowledgement, from the remote user interface device may, in some exemplary embodiments, be a directed advertisement, such as a directed BLUETOOTH® advertisement, sent to a fixed target address, e.g., an address of or associated with the household appliance 10, such as an address of the wireless module 92 (FIG. 6) of the household appliance 10. In some embodiments, the remote user interface device, e.g., a smartphone, such as remote user interface device 1000 illustrated in FIG. 6 and described above, may provide a prompt for authorization on a display of the remote user interface device 1000 or may otherwise request acknowledgment by a user via the remote user interface device 1000 of the attempt to connect the household appliance to the remote database, e.g., the cloud, 1100 (FIG. 6). Upon receipt of an input indicating authorization/acknowledgment from the user, the remote user interface device may then send the acknowledgement, e.g., directed advertisement, to the household appliance. The acknowledgement may include an instruction to initiate a provisioning guidance mode in the household appliance, e.g., for provisioning the household appliance onto a WI-FI® network. In some embodiments, the provisioning guidance mode may be time-limited, e.g., may include a time out feature. The time out may include the appliance terminating the provisioning guidance mode automatically after a predetermined time limit has expired with no input received from the user interface physically connected to the household appliance during that predetermined time limit. The predetermined time limit may be between about one minute and about ten minutes, such as between about two minutes and about seven minutes, such as about three minutes or about five minutes, etc. The time out mode may be advantageous, for example, as an additional security feature, such as to prevent or reduce the likelihood of the appliance being commissioned remotely.

The provisioning guidance mode may include, such as method 400 of FIG. 7 may include, providing an indication on a user interface physically connected to the household appliance, e.g., as illustrated at 430 in FIG. 7. The indication may indicate an element of the user interface physically connected to the household appliance to select in order to cause the household appliance to enter commissioning mode. The element may be, for example, a button or key on the household appliance (example embodiments of a button or key include a soft key on a display of the household appliance). For example, the remote user interface device may prompt or instruct the user to actuate, e.g., press, a commissioning element (button, key, etc., as described) of the user interface physically connected to the household appliance, and the indication may assist the user in locating the correct element. In some embodiments, the method 400 may also include providing an alert on a second device, e.g., a second household appliance, where the second household appliance may be an already-provisioned and connected household appliance on the same user account to which the household appliance is being provisioned.

In at least some embodiments, the household appliance may not include a dedicated provisioning input selector, e.g., the element of the user interface physically connected to the household appliance that is selected in order to cause the household appliance to enter commissioning mode may not be a dedicated provisioning element, e.g., button or key. Rather, the element may have a primary function, such as selecting a cycle or setting for operation of the household appliance, e.g., a rinse cycle for a dishwashing appliance, a particular cycle for a specific type of laundry, e.g., colors, in a washing machine appliance, and/or a timed dry cycle (or any other drying cycle, such as a sensor-based dry cycle) in a dryer appliance, among numerous other possible exemplary primary functions for an element of a user interface of a household appliance, and the provisioning function of the element may be a secondary function which is labelled less prominently than the primary function, or not specifically labelled at all. Accordingly, providing additional guidance to the element may be useful, such as the indication described herein.

In some embodiments, the indication may be or include illuminating a light, e.g., a light-emitting diode (LED), associated with the element of the user interface physically connected to the household appliance. The light may be illuminated steadily, e.g., constantly until the element is pressed or otherwise actuated, or the light may blink, e.g., illuminating the light may include intermittently illuminating the light. The light may be associated with the element in that the light is positioned proximate to the element, such as more proximate to the element of the user interface that is selected in order to cause the household appliance to enter commissioning mode than to any other element of the user interface, where the other elements of the user interface are of the same general type as the commissioning element, e.g., when the commissioning element is a commissioning button, the other elements include one or more other buttons, etc. For example, one or more of the other elements, e.g., other buttons other than the commissioning button, of the user interface physically connected to the household appliance may also have lights, e.g., LEDs, associated therewith in the same manner as the light associated with the commissioning element, which is described above. In some embodiments, the indication may also or instead include deactivating all other lights of the user interface, such as deactivating lights associated with the other element of the user interface, whereby only the light associated with the commissioning element remains illuminated, such as steadily illuminated or intermittently illuminated.

In some embodiments, the indication may also or instead include providing an audible indication, such as a beep, chime, etc. In embodiments where both a visual, e.g., light, indication and an audible indication are provided, the indications may be synchronized, such as the light may blink and the beep may sound at the same frequency. In some embodiments, the indication may also or instead include providing text instructions on a display of the user interface physically connected to the household appliance, such as a written indication of which element, e.g., button, to press, such as a written instruction to press a specific key or button, where the key or button (or other element) may be identified by the primary function thereof in the text indication, e.g., when the primary function is other than commissioning the household appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of provisioning a household appliance, the method comprising:

transmitting a signal from the household appliance to a remote user interface device;

receiving, by the household appliance, an acknowledgement from the remote user interface device in response to the signal; and providing an indication on a user interface physically connected to the household appliance, the indication indicating an element of the user interface physically connected to the household appliance to select in order to cause the household appliance to enter commissioning mode.

2. The method of claim 1, further comprising initiating, by the household appliance, a provisioning guidance mode after receiving the acknowledgement from the remote user interface device, and automatically terminating, by the household appliance, the provisioning guidance mode after a predetermined time limit has expired with no input received from the user interface physically connected to the household appliance during the predetermined time limit.

3. The method of claim 1, wherein providing the indication comprises illuminating a light associated with the element of the user interface physically connected to the household appliance.

4. The method of claim 3, wherein providing the indication further comprises deactivating all other lights of the user interface.

5. The method of claim 1, wherein providing the indication comprises providing an audible indication.

6. The method of claim 1, wherein providing the indication comprises providing text instructions on a display of the user interface physically connected to the household appliance.

7. The method of claim 1, further comprising providing an alert on an additional household appliance, where the additional household appliance is already provisioned.

8. The method of claim 1, wherein the transmitted signal from the household appliance comprises a low-energy short-range radio signal.

9. The method of claim 1, wherein the transmitted signal from the household appliance comprises a non-connectable advertisement.

10. The method of claim 1, wherein the household appliance does not include a dedicated provisioning input selector.

11. A household appliance comprising:

a controller, the controller, the controller configured for:

transmitting a signal from the household appliance to a remote user interface device;

receiving an acknowledgement from the remote user interface device in response to the signal; and providing an indication on a user interface physically connected to the household appliance, the indication indicating which element of the user interface physically connected to the household appliance to select in order to cause the household appliance to enter commissioning mode.

12. The household appliance of claim 11, wherein the controller is further configured for initiating a provisioning guidance mode after receiving the acknowledgement from the remote user interface device and for automatically terminating the provisioning guidance mode after a predetermined time limit has expired with no input received from the user interface physically connected to the household appliance during the predetermined time limit.

13. The household appliance of claim 11, wherein providing the indication comprises illuminating a light associated with the element of the user interface physically connected to the household appliance.

14. The household appliance of claim 13, wherein providing the indication further comprises deactivating all other lights of the user interface.

15. The household appliance of claim 11, wherein providing the indication comprises providing an audible indication.

16. The household appliance of claim 11, wherein providing the indication comprises providing text instructions on a display of the user interface physically connected to the household appliance.

17. The household appliance of claim 11, wherein the transmitted signal from the household appliance comprises a low-energy short-range radio signal.

18. The household appliance of claim 11, wherein the transmitted signal from the household appliance comprises a non-connectable advertisement.

19. The household appliance of claim 11, wherein the acknowledgement is a directed advertisement.

20. The household appliance of claim 11, wherein the household appliance does not include a dedicated provisioning input selector.

* * * * *